US008112190B2

(12) United States Patent
Yamada

(10) Patent No.: US 8,112,190 B2
(45) Date of Patent: Feb. 7, 2012

(54) BOAT CONTROL SYSTEM AND BOAT

(75) Inventor: Takashi Yamada, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 957 days.

(21) Appl. No.: 12/109,369

(22) Filed: Apr. 25, 2008

(65) Prior Publication Data

US 2008/0269970 A1 Oct. 30, 2008

(30) Foreign Application Priority Data

Apr. 27, 2007 (JP) ..... 2007-118521

(51) Int. Cl.
*B60L 3/00* (2006.01)

(52) U.S. Cl. ..... 701/21; 701/29.7; 701/31.4; 701/36; 340/438; 340/439

(58) Field of Classification Search ..... 701/29, 701/34–36, 48, 21; 340/438–439; 440/2, 440/84

See application file for complete search history.

(56) References Cited

U.S. PATENT DOCUMENTS 6,381,523 B2 4/2002 Sone
7,108,570 B2 * 9/2006 Okuyama ..... 440/84
7,349,479 B2 3/2008 Suganuma et al.
2004/0064539 A1 4/2004 Itoi
2007/0000712 A1 1/2007 Kamiya
2007/0270055 A1 * 11/2007 Ito et al. ..... 440/87

FOREIGN PATENT DOCUMENTS

JP 04-38297 A 2/1992
JP 07-15446 A 1/1995
JP 2004-297194 A 10/2004
JP 2006-135375 A 5/2006

* cited by examiner

*Primary Examiner* — Thomas Black
*Assistant Examiner* — Luke Huynh
(74) *Attorney, Agent, or Firm* — Keating & Bennett, LLP

(57) ABSTRACT

A boat control system detects a wire break status in a duplicated communication system. A hull of a boat is provided with a main remote control side ECU and a subremote control side ECU, and the subremote control side ECU communicates with an engine side ECU via the main remote control side ECU. Both of the remote control side ECUs are provided with storage buffers in which communication status confirmation data transmitted between nodes is stored. A broken wire detection section of the engine side ECU starts a determination when a system is started, and broken wire detection sections of both of the remote control side ECUs start a determination when communication status confirmation data is received from another node. Data indicating that communication is in an abnormal status is stored as an initial value in a main remote control data storage buffer.

8 Claims, 8 Drawing Sheets

BOAT CONTROL SYSTEM AND BOAT

BACKGROUND OF THE INVENTION

1. Field of the invention

The present invention relates to a boat control system having a boat propulsion system and a remote control device for transmitting an operation signal to the boat propulsion system, and further relates to a boat provided with the boat control system.

2. Description of the Related Art

A conventional technique in this field is disclosed in JP-A-04-38297.

According to JP-A-04-38297, an outboard motor including an internal combustion engine, a propeller for propulsion, and so forth is provided on the outside of the boat main body; a steering motor for horizontally rotating the outboard motor is provided on a connecting portion between the boat main body and the outboard motor; and a steering motor and a steering wheel as a boat propulsion unit operation device provided near an operator's seat are connected by a communication line via which signals can be sent and received.

According to JP-A-04-38297, it is disclosed that the communication line for performing communication between a pair of nodes is duplicated so that communication is normally performed by one communication line if the other communication line is broken. This may increase the resistance to a communication failure.

A technique in which communication lines of a boat are duplicated is illustrated in FIG. 6. In the drawing, an engine side electric control unit (ECU) for controlling an engine of an outboard motor is provided in the outboard motor as an example of a boat propulsion system, and a remote control side ECU is provided in a remote control device which transmits an operation signal to the boat propulsion system.

The engine side ECU and the remote control side ECU define duplicated communication paths in which a pair of nodes is connected by a pair of communication lines to secure appropriate communication. Consequently, even when one communication line is broken, communication is normally performed via the other communication line to provide engine control.

Moreover, to further secure safety, a warning is given to an operator by lighting a lamp or by some other method if one communication line is broken. If the two communication lines are broken, the engine is stopped (fail control) to control the generation of the propulsive force.

In other words, the engine side ECU and the remote control side ECU detect a wire break in the network. A system is started (a main switch is turned on) as shown in FIG. 7(*a*). After this, as shown in FIG. 7(*b*), one communication line (CAN Ch1) is turned from a "Normal" status to a "Wire break" status. After a time-out determination time passes, Ch1 error information is changed from "None" indicating that a target communication line is in a status in which no abnormality is found, to "Issued" indicating that the target communication line is causing an abnormality and is in a status in which communication is impossible. Consequently, a system mode is turned from a "Normal" mode indicating that the both of the duplicated communication paths are normal to a "Warning" mode indicating that one of the duplicated communication paths is in a status in which there is an abnormality. As a result, an operator is informed of the fact that a wire break occurs in one of the duplicated communication paths by lighting a warning lamp or by some other method.

After one of the duplicated communication paths is broken in the network, the other communication line (CAN Ch2) may be turned from the "Normal" mode to the "Wire break" mode. In this case, as shown in FIG. 7(*c*), after the time-out determination time passes, Ch2 error information is changed from "None" to "Issued." Consequently, a system status is turned from the "Warning" status to an operation mode at the time when both of the duplicated communication paths cannot perform communication, that is, a "Fail" mode as an operation mode for securing appropriate navigation of the boat. As a result, fail control is performed as a control for securing appropriate running of the boat, and thereby a throttle is set to a fully closed status.

However, according to the network assumed on the basis of the invention described in JP-A-04-38297, a wire break in relation to the engine side ECU and a wire break in relation to the remote control side ECU are both detected on the basis of a change in a communication status after the system is started (a change in continuity of an electrical signal, a change in a status of data transfer, and the like). Therefore, a problem illustrated in FIGS. 8(*a*)-8(*c*) may occur.

As shown in FIG. 8(*a*) and FIG. 8(*b*), assume that one communication line (CAN Ch1) in the duplicated communication paths is already broken before the system is started (before the main switch is turned on) in the assumed network. In this case, the one communication line does not cause a change in a communication status after the system is started (after the main switch is turned on). Therefore, the wire break is not detected, and, accordingly, the Ch1 error information remains "None." As a result, the "Warning" mode is not set, and the operator does not recognize that the one communication line is broken.

Further, assuming that after the system is started, another communication line (CAN Ch2) in the duplicated communication paths in which the one communication line has been already broken may be turned from the "Normal" mode to the "Wire break" mode in the assumed network. In this case, after the time-out determination time passes, Ch2 error information is changed from "None" to "Issued." Accordingly, each ECU determines that a first communication line is broken. As a result, as shown in FIG. 8(*c*), the "Normal" mode is turned to the "Warning" mode, and nothing other than lighting the warning lamp or the like may be performed.

On the other hand, it may be considered that the wire break is detected on the basis of a communication status between the engine side ECU and the remote control side ECU at a time of a system start in the assumed network. In this case, it may be necessary to change settings of the remote control side ECU depending on whether one remote control side ECU or a plurality of remote control side ECUs is provided on one hull. Specifically, in the former case, since the remote control side ECU communicates with the engine side ECU as the only node, it is only necessary to determine a communication status with the engine side ECU at a time of a system start. On the other hand, in the latter case, it is necessary for at least one remote control side ECU to determine a communication status of a plurality of nodes (another remote control side ECU and the engine side ECU, for example) at a time of a system start. Consequently, it is necessary to change the arrangement depending on whether one remote control side ECU is provided or a plurality of remote control side ECUs is provided on one hull. Therefore, it is difficult to commonly use one ECU as a remote control side ECU in a case in which one remote control side ECU is provided on one hull and also as an ECU in a case in which a plurality of remote control side ECUs is provided on one hull. This causes a problem in which manufacturing processes and the cost in commercialization are increased.

SUMMARY OF THE INVENTION

In order to overcome the problems described above, preferred embodiments of the present invention provide a boat control system in which a wire break condition is appropriately detected in a duplicated communication system while an increase in the manufacturing processes and costs is controlled, and provide a boat including the boat control system.

A first preferred embodiment of the present invention provides a boat control system including an engine side ECU, provided in a boat propulsion system having an engine for providing a propulsive force to a hull, and arranged to control an operation status of the boat propulsion system; a main remote control side ECU, provided in a main remote control device of the hull, arranged to transmit a command signal on the basis of a boat operation command from an operator to the engine side ECU; and a communication line having the engine side ECU and the main remote control side ECU as nodes for communicatively connecting the nodes. The engine side ECU and the main remote control side ECU are preferably provided with a confirmation data storage buffer, respectively, in which communication status confirmation data is stored for confirming whether or not communication between the nodes can be performed by communicating between the nodes, and a broken wire detection device which monitors the communication time of the communication status confirmation data and determines as a result of the monitoring that the communication line connecting the nodes, for which communication is not confirmed, is broken if communication of the communication status confirmation data is not confirmed between the nodes within a predefined period of time. The broken wire detection device of the engine side ECU starts the determination when the boat control system is started, and the broken wire detection device of the main remote control side ECU starts the determination when the communication status confirmation data is received from the other one of the nodes.

According to a second preferred embodiment of the present invention, a subremote control device separated from the main remote control device is further provided, and a subremote control side ECU provided in the subremote control device is preferably connected to the engine side ECU via the main remote control side ECU by connecting the subremote control side ECU to the main remote control side ECU via a communication line.

According to a third preferred embodiment of the present invention, data whose initial status indicates that communication between the nodes is in an abnormal status is preferably stored as the communication status confirmation data in the confirmation data storage buffer provided in the subremote control side ECU. The broken wire detection device provided in the subremote control side ECU preferably overwrites the communication status confirmation data stored in the confirmation data storage buffer with data indicating that communication is in a normal status when the communication status confirmation data is received from the other one of the nodes and transmits overwritten communication status confirmation data to the other one of the nodes.

According to a fourth preferred embodiment of the present invention, the main remote control side ECU and the subremote control side ECU preferably have the confirmation data storage buffer and the broken wire detection device of a similar construction, respectively, and each of the broken wire detection device of the main remote control side ECU and the subremote control side ECU performs determination respectively by using necessary data among the data stored in the confirmation data storage buffer.

According to a fifth preferred embodiment of the present invention, two communication lines are preferably provided for each of the communication lines connecting the nodes, and the fifth preferred embodiment further includes an operation status switch device arranged to set a warning mode for giving a warning in a status in which the boat propulsion system can operate when the broken wire detection device determines that only one of the two communication lines is broken, and to set a fail mode as a status in which propulsive force of the boat propulsion system is not generated when the broken wire detection device determines that both of the two communication lines are broken.

According to a sixth preferred embodiment of the present invention, the operation status switch device preferably interrupts control for setting the fail mode when the broken wire detection device determines that the two communication lines connecting the main remote control side ECU and the subremote control side ECU are broken at a start of the boat control system.

According to a seventh preferred embodiment of the present invention, the operation status switch device forcibly shifts a throttle of the boat propulsion system to a fully closed status at a time of the fail mode and forcibly shifts a gear of the boat propulsion system to a neutral status.

An eighth preferred embodiment of the present invention is directed to a boat provided with the boat control system according to any one of the first to seventh preferred embodiments.

According to the first preferred embodiment of the present invention, the engine side ECU and the main remote control side ECU are provided with the confirmation data storage buffer in which communication status confirmation data is stored for confirming whether or not communication between the nodes can be performed by performing communication between the nodes, and the broken wire detection device which monitors communication time of the communication status confirmation data and determines as a result of monitoring that the communication line connecting the nodes between, for which communication is not confirmed, is broken if communication of the communication status confirmation data is not confirmed between the nodes within a predefined period of time. The broken wire detection device of the engine side ECU starts when the boat control system is started, and the broken wire detection device of the main remote control side ECU starts the determination when the communication status confirmation data is received from the other one of the nodes. As a result, a communication status of the main remote control side ECU is surely detected in the engine side ECU. Further, the main remote control side ECU can determine a wire break of a communication line without difficulty regardless of whether or not another remote control side ECU is provided on an operator's seat side or a number of other remote control side ECUs. Accordingly, it is possible to provide the main remote control side ECU with a high versatility. As a result, it is possible to appropriately detect a wire break condition in a duplicated communication system while the manufacturing processes and costs are reduced.

According to the second preferred embodiment of the present invention, the subremote control device is separate from the main remote control device, and the subremote control side ECU provided in the subremote control device is connected to the engine side ECU via the main remote control side ECU by connecting the subremote control side ECU to the main remote control side ECU via a communication line. Accordingly, a wire break condition of a communication line formed in a communication system duplicated between nodes can be determined without difficulty in a system in which a plurality of remote control side ECUs is provided, wherein one of the remote control side ECUs directly communicates with the engine side ECU, and the other remote control side ECUs indirectly communicate with the engine side ECU via the main mote control side ECU. As a result, it is possible to further appropriately detect the wire break condition in a duplicated communication system while the manufacturing processes and costs are surely reduced.

According to the third preferred embodiment of the present invention, data whose initial status indicates that communication between the nodes is in an abnormal status is stored as the communication status confirmation data in the confirmation data storage buffer provided in the subremote control side ECU. The broken wire detection device provided in the subremote control side ECU overwrites the communication status confirmation data stored in the confirmation data storage buffer with data indicating that communication is in a normal status when the communication status confirmation data is received from the other one of the nodes and transmits overwritten communication status data to the other one of the nodes. Consequently, the wire break condition of a communication line formed as a duplicated system between the subremote control side ECU and the main remote control side ECU is determined easily and surely only by a transmission status of data, and the wire break condition can be detected. As a result, it is possible to further appropriately detect the wire break condition in a duplicated communication system while the manufacturing processes and costs are surely reduced.

According to the fourth preferred embodiment of the present invention, the main remote control side ECU and the subremote control side ECU have the confirmation data storage buffer and the broken wire detection device of a similar construction, respectively, and each of the broken wire detection device of the main remote control side ECU and the subremote control side ECU performs the determination respectively by using necessary data among the data stored in the confirmation data storage buffer. Consequently, it is possible to provide the main remote control device and the subremote control device with the same construction with respect to hardware and software, and further a wire break of a communication line in a duplicated system between the main remote control side ECU and the subremote control side ECU is determined without difficulty. Accordingly, the wire break condition can be detected. As a result, it is possible to further appropriately detect the wire break condition in a duplicated communication system while the manufacturing processes and costs are surely reduced.

According to the fifth preferred embodiment of the present invention, two communication lines are provided for each of the communication lines connecting the nodes, and the fifth preferred embodiment further includes the operation status switch device arranged to set a warning mode for giving a warning in a status in which the boat propulsion system can operate when the broken wire detection device determines that one of the two communication lines is broken, and to set a fail mode as a status in which propulsive force of the boat propulsion system is not generated when the broken wire detection device determines that both of the two communication lines are broken. Consequently, when the wire break occurs in the communication lines in a duplicated system, if navigation is still possible, the operator is given a warning, and continuous navigation is enabled. If navigation is impossible because of an occurrence of a wire break, it can be prevented that the boat is propelled in a condition in which navigation is impossible. As a result, a warning is appropriately given on the basis of a result of a correct detection of a wire break condition, and, at the same time, an appropriate action can be prompted.

According to the sixth preferred embodiment of the present invention, the operation status switch device interrupts setting the fail mode when the broken wire detection device determines that both of the two communication lines connecting the main remote control side ECU and the subremote control side ECU are broken at the start. Consequently, it is prevented that the system makes transition to the fail mode to prohibit navigation in a status in which communication between the main remote control side ECU and the engine side ECU is possible and navigation is thereby possible. As a result, it is prevented that navigation is unnecessarily obstructed on the basis of a result of an incorrect detection of a wire break condition.

According to the seventh preferred embodiment of the present invention, the operation status switch device forcibly shifts a throttle of the boat propulsion system to a fully closed status at a time of the fail mode and forcibly shifts a gear of the boat propulsion system to a neutral status. Consequently, it is surely prevented that the boat propulsion system generates a propulsive force when the system makes transition to the fail mode. As a result, an appropriate action can be prompted on the basis of a result of correct detection of a wire break condition.

According to the eighth preferred embodiment of the present invention, a boat provided with the boat control system having the above benefits and advantages described above can be provided.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter.

FIG. 1 to FIG. 5 illustrate a preferred embodiment of the present invention.

Figure 1:
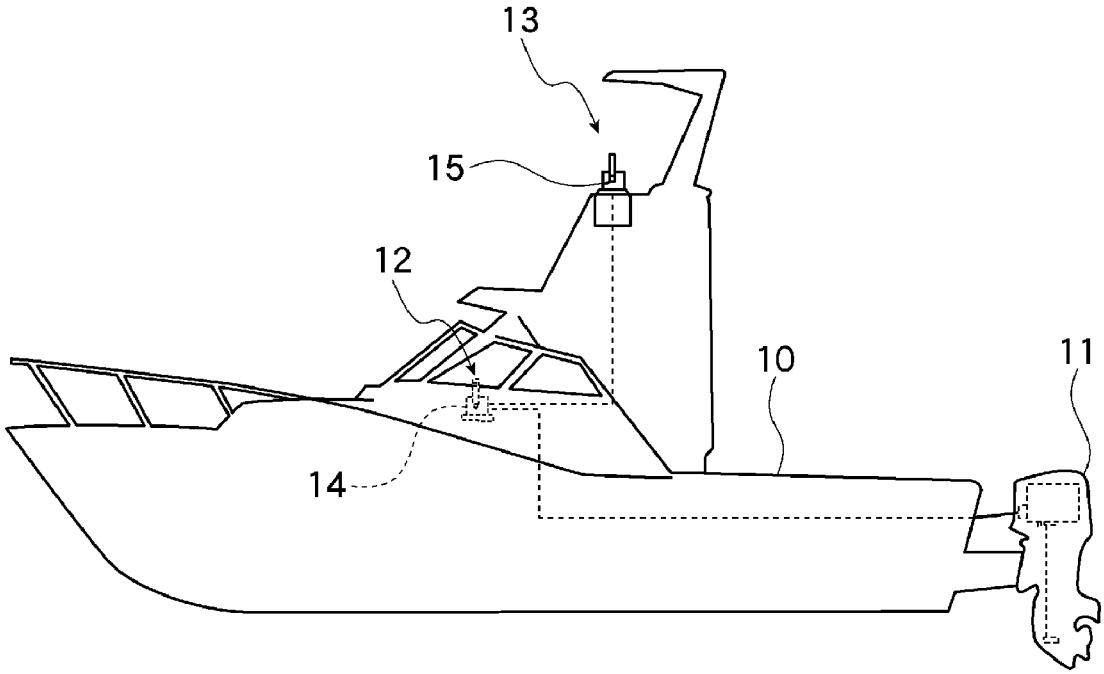
FIG. 1 is a schematic view of a boat according to a preferred embodiment of the present invention.

An overall construction will be described first. As shown in FIG. 1, an outboard motor 11 as an example of a boat propulsion system is attached to a stern of a hull 10 of a boat. The outboard motor 11 has an engine (not shown) which provides a propulsive force to the hull 10 by rotating a propeller (not shown) and a gear (not shown) which shifts a rotation status and a direction of a propeller shaft (not shown) between a forward drive, reverse drive, and neutral. The outboard motor 11 is operated from two operator's seats (a main station 12 and a substation 13).

As shown in FIG. 1, a main remote control device 14, a key switch device (not shown), and a steering wheel device are disposed in the main station 12. A subremote control device 15, a key switch device (not shown), and a steering wheel device are disposed in the substation 13 in a similar manner.

Figure 2:
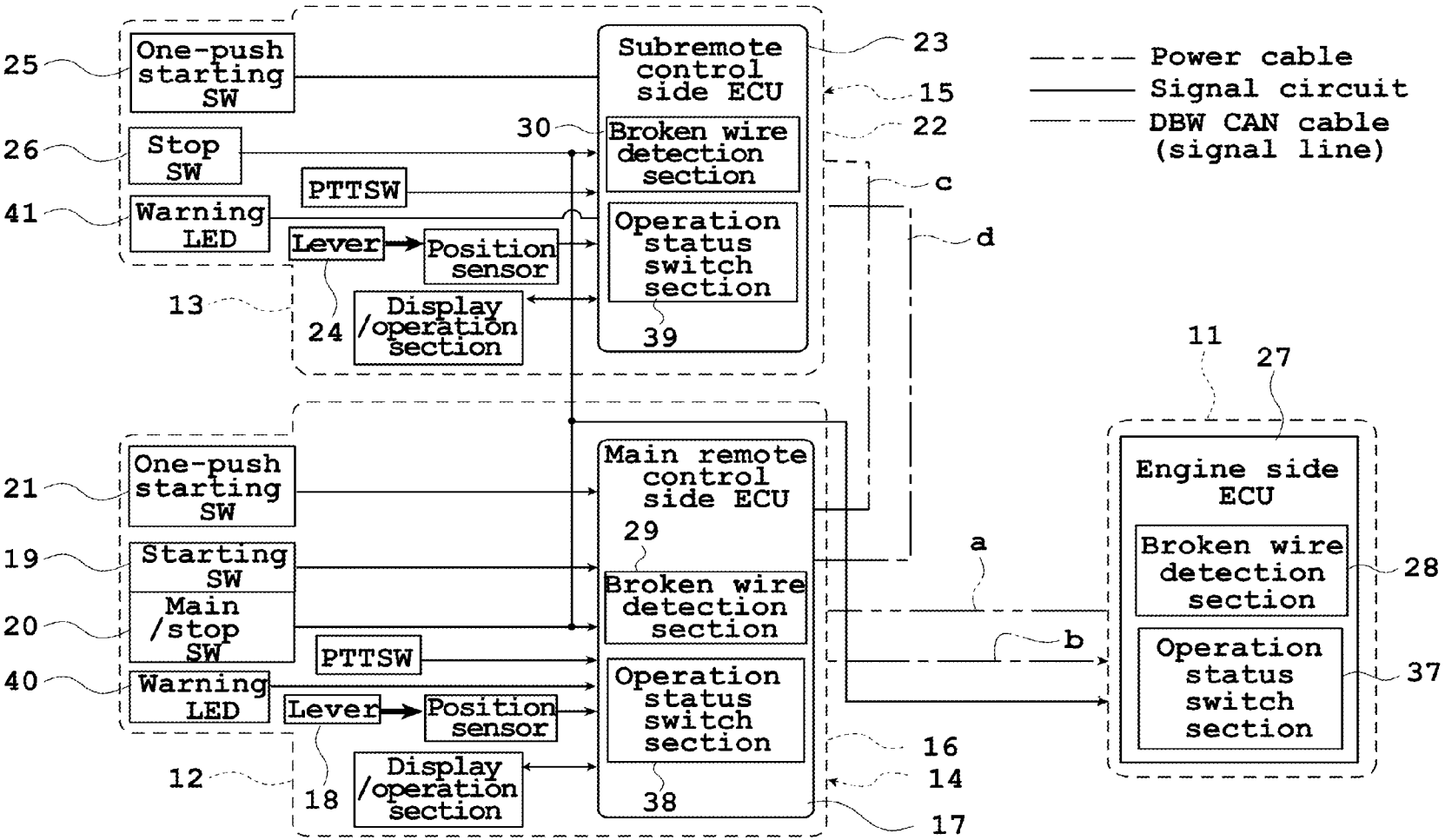
FIG. 2 is a schematic view illustrating a network of the boat according to a preferred embodiment of the present invention.

As shown in FIG. 2, the main remote control device 14 in the main station 12 has a main remote control side ECU 17 contained in a remote control main body 16 and is provided with a remote control lever 18 for performing a throttle operation and a shift operation. Further, a position sensor (not shown) for detecting a position of the remote control lever 18 is provided, and the position sensor is connected to the main remote control side ECU 17 via a signal circuit. In addition, a power trim and tilt (PTTSW) switch is connected to the main remote control side ECU 17 via a signal circuit.

Further, the key switch device is connected to the main remote control side ECU 17 of the main remote control device 14. The key switch device is provided with a starting switch 19, a main/stop switch 20, and a one-push starting switch 21. The starting switch 19, the main/stop switch 20, and the one-push starting switch 21 are connected to the main remote control side ECU 17 via signal circuits.

The steering wheel device contains a steering wheel side ECU (not shown) and is provided with a steering wheel for performing steering. A position of the steering wheel is detected by the position sensor, and the position sensor is connected to the steering wheel ECU via a signal circuit.

The steering wheel side ECU of the steering wheel device is connected to the main remote control side ECU 17 of the main remote control device 14 via two communication lines (DBW CAN cables). Here, DBW stands for Drive-By-Wire, indicating an operation device which performs an operation (steering of the outboard motor 11, for example) by using an electric connection in place of a mechanical connection, and CAN stands for Controller Area Network.

On the other hand, the subremote control device 15 in the substation 13 has a subremote control side ECU 23 contained in a remote control main body 22 and is provided with a position sensor for detecting a position of a remote control lever 24 in a manner similar to the main station 12. The position sensor is connected to the subremote control side ECU 23 via two signal circuits. In addition, a power trim and tilt (PTTSW) switch is connected to the subremote control side ECU 23 via a signal circuit.

Further, the key switch device is connected to the subremote control side ECU 23 of the subremote control device 15. The key switch device is provided with a one-push starting switch 25 and a stop switch 26. The one-push starting switch 25 and the stop switch 26 are connected to the subremote control side ECU 23 via a signal circuit.

A steering wheel device is connected to the subremote control device 15 in a manner similar to the main station 12.

The main remote control side ECU 17 and the subremote control side ECU 23 are provided with the same construction with respect to hardware and software, and, as described below, the only difference between these ECUs is a mounting position for a harness (not shown).

Further, the outboard motor 11 is provided with an engine side ECU 27 which controls the engine. The engine side ECU 27 is connected to the main remote control side ECU 17 in the main station 12 via two communication lines "a" and "b" of the two systems.

The main remote control side ECU 17 in the main station 12 is connected to the subremote control side ECU 23 in the substation 13 via two communication lines "c" and "d" of the two systems.

Figure 3:
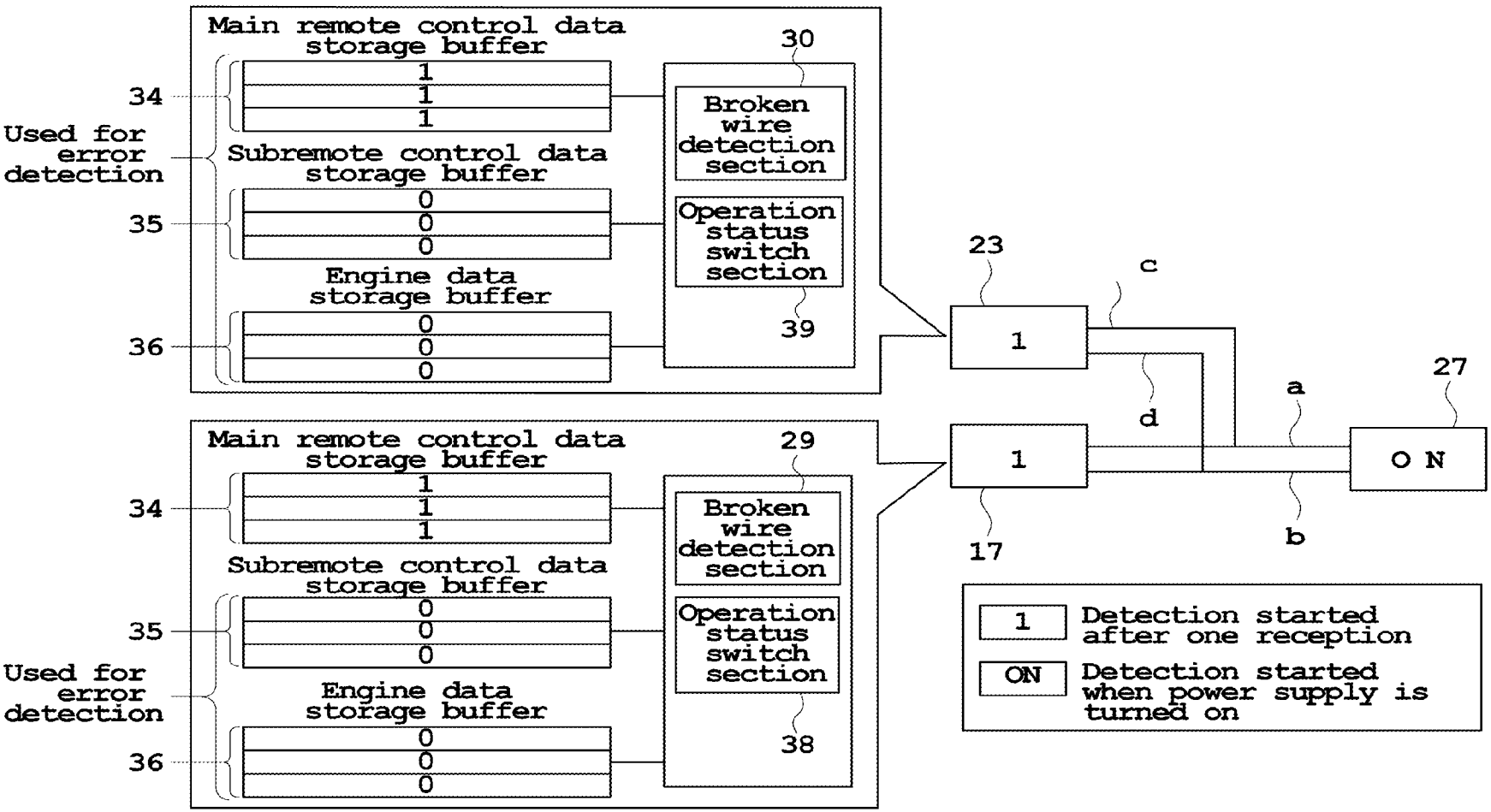
FIG. 3 is a view of a network and three storage buffers connected to a main remote control side ECU and a subremote control side ECU of the boat according to a preferred embodiment of the present invention.
Figure 4:
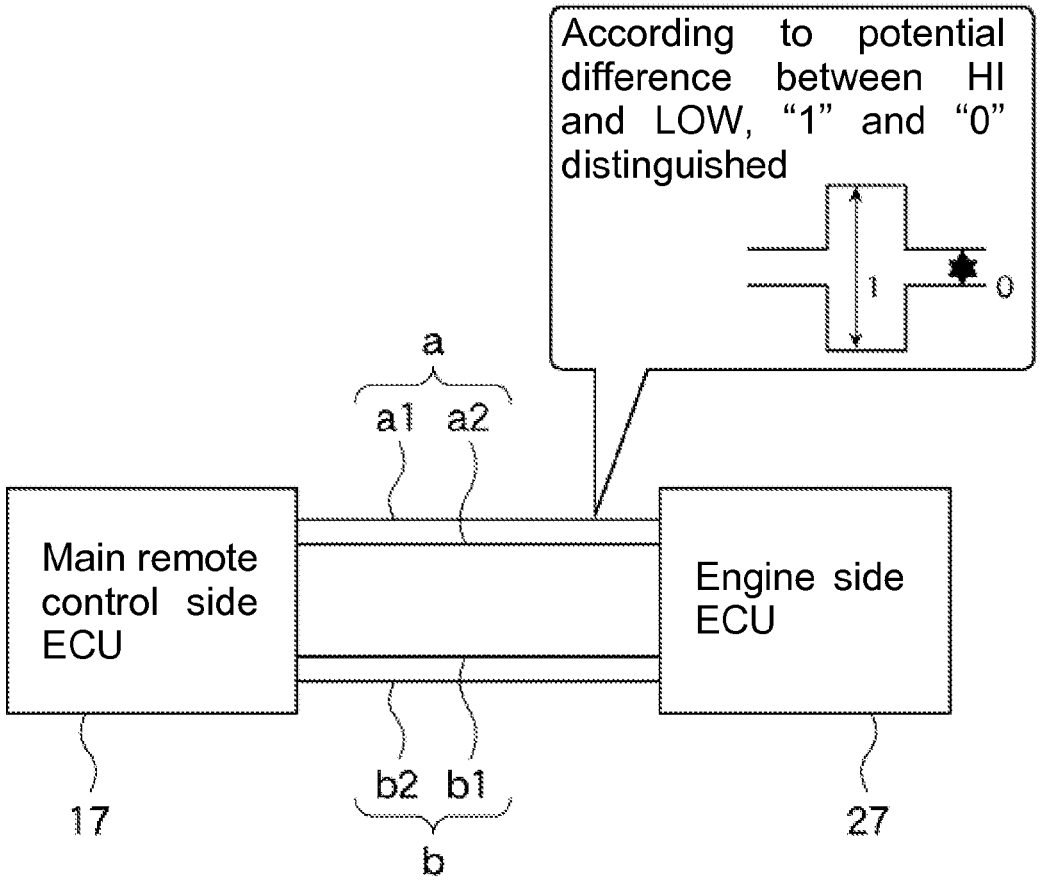
FIG. 4 is a view illustrating details of communication lines connecting an engine side ECU and a main remote control side ECU of the boat according to a preferred embodiment of the present invention.

To be more accurate, as shown in FIG. 4, each of the two communication lines "a" and "b" has two lines a1 and a2 and b1 and b2. In other words, the two communication lines "a" and "b" have the four lines a1, a2, b1, and b2 in all. However, a combination of the lines a1 and a2 or the lines b1 and b2 can transmit one signal. Therefore, these communication lines are indicated as the communication lines "a" and "b" in FIG. 3. Only the communication lines "a" and "b" are shown in FIG. 4. However, each of the communication lines "c" and "d" has two lines. In other words, there are four lines in all. One signal is transmitted by a combination of the two lines defining the communication lines "c" and "d" combination of the two lines defining the line "d".

The engine side ECU 27 is provided with a broken wire detection section 28. The broken wire detection section 28 performs an error detection when the power supply is turned on and detects whether or not the two communication lines "a" and "b" are broken. Specifically, when the power supply is turned on, it is detected whether or not a signal is transmitted from the main remote control side ECU 17 via the two communication lines "a" and "b". If a signal is not detected, it is determined that an error occurs and that the line is broken.

The main remote control side ECU 17 and the subremote control side ECU 23 preferably have the same internal construction. In other words, these remote control side ECUs 17 and 23 are provided with broken wire detection sections 29 and 30 as an example of a broken wire detection device. The broken wire detection sections 29 and 30 monitor communication time of communication status confirmation data described below and, if communication of the communication status confirmation data between nodes is not confirmed within a predefined period of time as a result of monitoring, it determines that the communication lines "a", "b", "c", and "d" connecting the nodes between, for which communication is not confirmed, are broken.

After receiving signals from the other ECUs 27, 23, and 17, the broken wire detection sections 29 and 30 perform an error detection to detect whether or not the two communications lines "a" and "b" and "c" and "d" are broken.

Specifically, after a system start, the broken wire detection section 29 of the main remote control side ECU 17 receives a signal one time from another node (for example, the engine side ECU 27). After this, it is detected whether or not signals are transmitted within the predefined period of time from all of the other nodes, which are the engine side ECU 27 and the subremote control side ECU 23 in the present preferred embodiment. If a signal is not detected, an error detection is performed in relation to the communication lines "a", "b", "c", and "d" connected to a node in question, and it is determined that the communication lines "a", "b", "c", and "d" are broken. On the other hand, the subremote control side ECU 23 detects whether or not a signal is transmitted from the main remote control side ECU 17. If a signal is not detected, an error detection is performed in relation to the communication lines "c" and "d", and it is determined that the communication lines "c" and "d" are broken.

Three storage buffers 34, 35, and 36 as an example of a confirmation data storage buffer are connected to the broken wire detection section 29 of the main remote control side ECU 17 and the broken wire detection section 30 of the subremote control side ECU 23, respectively, as schematically illustrated in FIG. 3. The storage buffers 34, 35, and 36 are a main remote control data storage buffer 34, a subremote control data storage buffer 35, and an engine data storage buffer 36. Communication status confirmation data is stored in the storage buffers 34, 35, and 36 for confirming whether or not communication between nodes is possible by performing communication between the nodes. There are two types, which are "0" and "1," of communication status confirmation data, and "1" indicating that the communication line is in an abnormal status is stored as an initial value in the main remote control data storage buffer 34. When receiving data from another node within the predefined period of time (within 1 sec, for example), the broken wire detection sections 29 and 30 overwrite the data "1" with the data "0" indicating that the communication line is in a normal status. In other words, the data "1" functions as a time-out error flag indicating that data is not received within the predefined period of time (as described below in detail).

On the other hand, "0" is stored as an initial value in the subremote control data storage buffer 35 and the engine data storage buffer 36. The data is overwritten with "1" if the communication line is in an abnormal status.

A main remote control data storage buffer (not shown) is provided in the engine side ECU 27 as an example of a confirmation data storage buffer. The data "0" indicating that the communication line is in a normal status or the data "1" indicating that the communication line is in an abnormal status is stored as communication status confirmation data in a manner similar to the storage buffer. The main remote control data storage buffer of the engine side ECU 27 stores "0" as an initial value. The initial value is overwritten with "0" or "1" according to whether or not data is received within the predefined period of time.

Each of the remote control side ECUs 17 and 23 identifies itself as the main remote control side ECU 17 or the subremote control side ECU 23 depending on a connecting location of a harness (not shown). The main remote control side ECU 17 and the subremote control side ECU 23 have a harness connected to a different location. When the system is started, a signal is transmitted to the harness. Each of these ECUs identifies itself as the main remote control side ECU 17 or the subremote control side ECU 23 according to a reception status of the transmitted signal.

As a result of such identification, if an ECU identifies itself as the main remote control side ECU 17, the main remote control side ECU 17 does not use the main remote control data storage buffer 34 but uses the subremote control data storage buffer 35 and the engine data storage buffer 36 to perform an error detection. On the other hand, as a result of identification, if an ECU identifies itself as the subremote control side ECU 23, the subremote control side ECU 23 uses the main remote control data storage buffer 34 and the engine data storage buffer 36 to perform an error detection (see FIG. 3).

The main remote control side ECU 17 and the subremote control side ECU 23 are provided with operation status switch sections 38 and 39 respectively as an example of an operation status switch device. When it is determined that one of a pair of the communications lines "a" and "b" or a pair of the communications lines "c" and "d" is broken, the operation status switch sections 38 and 39 set a warning mode for giving a warning in a status in which the outboard motor 11 is operable (hereinafter referred to as the "warning mode").

On the other hand, the engine side ECU 27 is provided with an operation status switch section 37 as an example of an operation status switch device. When it is determined that both of a pair of the communication lines "a" and "b" or a pair of the communication lines "c" and "d" are broken, the operation status switch section 37 sets a fail mode as a status in which propulsive force of the outboard motor 11 is not generated (hereinafter referred to as the "fail mode").

The main station 12 is provided with a warning LED 40 connected to the main remote control side ECU 17, and the substation 13 is provided with a warning LED 41 connected to the subremote control side ECU 23. When it is determined that a pair of the communication lines "a" and "b" or a pair of the communication lines "c" and "d" is in the warning mode or in the fail mode, the warning LEDs 40 and 41 are lit to notify the operator or the like of the mode.

An operation of the present preferred embodiment will be described hereinafter.

System Start and Determination Procedure in the Engine Side ECU

As described above, while the engine side ECU 27, the main remote control side ECU 17, and the subremote control side ECU 23 are connected by the two communication lines "a" and "b" and the communication lines "c" and "d", when the main/stop switch 20 is pushed to start the system (the power supply is turned on), the main remote control side ECU 17 and the subremote control side ECU 23 identify themselves as the main remote control side ECU 17 or the subremote control side ECU 23 depending on the connecting location of a harness (not shown). The main remote control side ECU 17 selects a storage buffer used for an error detection (determination of a wire break) from the storage buffers 34, 35, and 36 depending on a result of the identification (see FIG. 3).

On the other hand, when the system is started, the broken wire detection section 28 of the engine side ECU 27 is operated to determine whether or not the two communications lines "a" and "b" to the main remote control side ECU 17 are broken.

If a signal is not transmitted from the main remote control side ECU 17 within the predefined period of time (1 sec, for example) after the start of the system, the broken wire detection section 28 overwrites the data "0" in the main remote control data storage buffer (not shown) with "1" as the time-out error flag. Once having written the data "1" as the time-out error flag "1," the broken wire detection section 28 does not overwrite the data with "0" unless the system is shut down (the power supply is turned off).

If a signal is not received from the main remote control side ECU 17 via the communication lines "a" and "b", the broken wire detection section 28 determines that the communication lines "a" and "b" are broken. Here, if the broken wire detection section 28 determines that either one of the two communication lines "a" and "b" is broken, the broken wire detection section 28 determines that the warning mode should be initiated.

On the other hand, if the other one of the communication lines "a" and "b" is also broken, the broken wire detection section 28 determines that the fail mode should be initiated. Accordingly, the operation status switch section 39 forcibly shifts the throttle (not shown) of the engine (not shown) of the outboard motor 11 to the fully closed status on the basis of determination and forcibly shifts the gear (not shown) to the neutral status. The engine side ECU 27 detects a wire break on the basis of a communication status at a time of a system start. Therefore, even if both of the communication lines "a" and "b" are broken before the system start, or even if either one of the two communication lines "a" and "b" is broken before the system start and the other line is broken afterwards, it is surely detected that both of the communication lines "a" and "b" are broken.

Consequently, when the system is started (the power supply is turned on), it is detected whether or not the communications lines "a" and "b" are broken, and thereby the fail mode is surely set.

Determination Procedure in the Main Remote Control Side ECU

On the other hand, after a signal is received one time from the engine side ECU 27 and the subremote control side ECU 23, the broken wire detection section 29 starts an error detection in the main remote control side ECU 17. If a signal is not transmitted from the engine side ECU 27 or from the subremote control side ECU 23 within the predefined period of time (1 sec, for example), the broken wire detection section 29 overwrites the data "0" in the subremote control data storage buffer 35 or in the engine data storage buffer 36 in relation to a node from which a signal is not transmitted with "1" as the time-out error flag. Once having written the data "1" as the time-out error flag "1," the broken wire detection section 29 does not overwrite the data with "0" unless the system is shut down (the power supply is turned off).

When the broken wire detection section 29 determines that either one of a pair of the communications lines "a" and "b" or either one of the two communications lines "c" and "d" is broken and, therefore, that the warning mode should be initiated, the broken wire detection section 29 lights the warning LED 40 in the main station 12 based on the result of the determination.

On the other hand, when the broken wire detection section 29 determines that both of the two communications lines "c" and "d" are broken and, therefore, that the fail mode should be initiated, the broken wire detection section 29 transmits the result of the determination (data written in the storage buffers 34, 35, and 36) to the engine side ECU 27. When the engine side ECU 27 receives the result of the determination, the operation status switch section 37 forcibly shifts states of the throttle and the gear.

As described above, the broken wire detection section 29 of the main remote control side ECU 17 receives the signals from the engine side ECU 27 and the subremote control side ECU 23 one time before starting an error detection. A signal is not transmitted from the subremote control side ECU 23 in a boat in which the subremote control side ECU 23 is not provided. Therefore, if it is detected whether or not the communication lines "c" and "d" are broken on the basis of a communication status when the system is started (when the power supply is turned on), an error (a wire break status) is always detected in relation to the communication lines "c" and "d", and thereby an incorrect detection occurs. Consequently, if broken wire detection is performed on the basis of a communication status when the system is started (when the power supply is turned on), a construction of the main remote control side ECU 17 needs to be modified depending on whether or not the subremote control side ECU 23 is provided, and the manufacturing processes and costs of the system are increased. According to the preferred embodiments to overcome such drawbacks, the main remote control side ECU 17 has the same construction regardless of whether or not the subremote control side ECU 23 is provided. In addition, an error detection is started after a signal is received one time so that the incorrect detection described above can be prevented.

Determination Procedure in the Subremote Control Side ECU

Moreover, when receiving a signal from the main remote control side ECU 17, the broken wire detection section 30 of the subremote control side ECU 23 starts an error detection. When a signal is transmitted from the main remote control side ECU 17 within the predefined period of time (1 sec, for example), the broken wire detection section 30 determines that the communication status is in a normal status and overwrites the data "1" in the main remote control data storage buffer 34 with "0". If one or the both of the communications lines "c" and "d" are broken after the data is overwritten, the subremote control side ECU 23 cannot receive data sent from the main remote control side ECU 17 at certain regular intervals any more. In this case, if data is not received for the predefined period of time (1 sec, for example), the broken wire detection section 30 detects a communication error as a time-out error. Once having written the data "1" as the time-out error flag "1," the broken wire detection section 30 does not overwrite the data with "0" unless the system is shut down (the power supply is turned off).

If either one of the communication line "c" and the communication line "d" between the subremote control side ECU 23 and the main remote control side ECU 17 is broken in a status in which the system is started (when the power supply is turned on), data is not transmitted to the subremote control side ECU 23 from the main remote control side ECU 17. Therefore, the data in the main remote control data storage buffer 34 remains the initial value "1" even after the predefined period of time elapses. In this case, the broken wire detection section 30 determines that either one of the communication line "c" and the communication line "d" is in a wire break status and overwrites the data "0" in the main remote control data storage buffer 34 with "1" as the time-out error flag.

As described above, since the initial value of the data stored in the main remote control data storage buffer 34 is "1" indicating that the communication status is in an abnormal status before the system is started (the power supply is turned on), the wire break can be detected even if the commutation lines "a" and "b" between the subremote control side ECU 23 and the main remote control side ECU 17 are already broken when the system is started.

Even if the two communication lines "c" and "d" between the subremote control side ECU 23 and the main remote control side ECU 17 are broken, the broken wire detection section 30 does not determine that the fail mode should be initiated. This is because navigation is possible when the two communication lines "a" and "b" between the main remote control side ECU 17 and the engine side ECU 27 are not broken, and therefore it is not necessary to initiate the fail mode. If the broken wire detection section 30 determines that either or the both of the two communication lines "c" and "d" are broken, the broken wire detection section 30 determines that the warning mode should be initiated, and the operation status switch section 39 transmits the result of the determination to the engine side ECU 27 via the main remote control side ECU 17. When the engine side ECU 27 receives the result of the determination, the operation status switch section 39 lights the warning LED 40 of in the main station 12 and the warning LED 41 in the substation 13 on the basis of the determination.

Wire Break Status of a Pair of Signal Lines and Operation after Broken Wire Detection To be accurate, each of the two communication lines "a" and "b" between the engine side ECU 27 and the main remote control side ECU 17 has the two communication lines a1 and a2 or b1 and b2 as shown, for example, in FIG. 4. The two communication lines "a" and "b" have the four lines a1, a2, b1, and b2 in all. The line a1 is a HI line and the line a2 is a LOW line, or the line b1 is a HI line and the line b2 is a LOW line. As shown in FIG. 4, "1" and "0" are distinguished according to a potential difference between the HI line and the LOW line, and thus communication is performed by converting digital signals into bit rows.

Even if the broken wire detection sections 28 and 29 determine that both or either of the HI line and the LOW line of only one of the communications lines "a" or "b" is broken, bit rows are correctly transmitted by a combination of the HI line and the LOW line (for example, a combination of the HI line a1 and the LOW line a2) in the communication line "a" or "b" on the other side or, in other words, on a side which is not broken. In this case, the broken wire detection sections 28 and 29 determine that the warning mode should be initiated.

On the other hand, if either of the HI line and the LOW line in the communication line "a" is broken, and, in addition to this, if either of the HI line and the LOW line in the communication line "b" is broken (for example, if the HI line a1 and the LOW line b2 are broken, or if the HI line a2 and the LOW line b1 are broken), the level of "1" is only half a level thereof at a time when the communication status is in a normal status, and therefore correct data communication cannot be performed. Consequently, in this case, the broken wire detection sections 28 and 29 determine that the fail mode should be initiated.

Moreover, if all of the four lines a1, a2, b1, and b2 are broken, data communication cannot be performed when any line is used. Consequently, the broken wire detection sections 28 and 29 determine that the fail mode should be initiated.

Bus Off and a Countermeasure thereof

Figure 5:
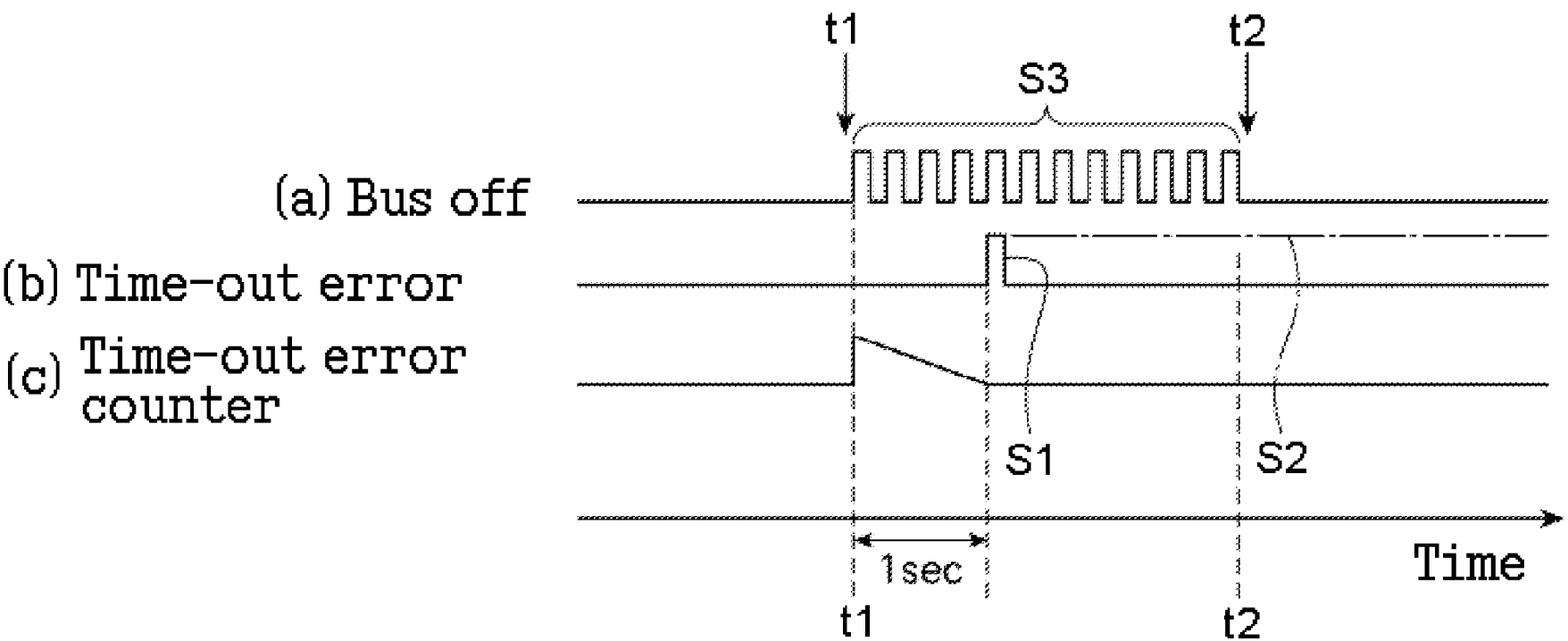
FIG. 5(*a*) is a view illustrating a signal status during a bus off, FIG. 5(*b*) is a view of a conventional time-out error flag and a time-out error flag of a preferred embodiment of the present invention, and FIG. 5(*c*) is a view of a signal of a count by a time-out error counter of the boat according to a preferred embodiment of the present invention.
Figure 6:
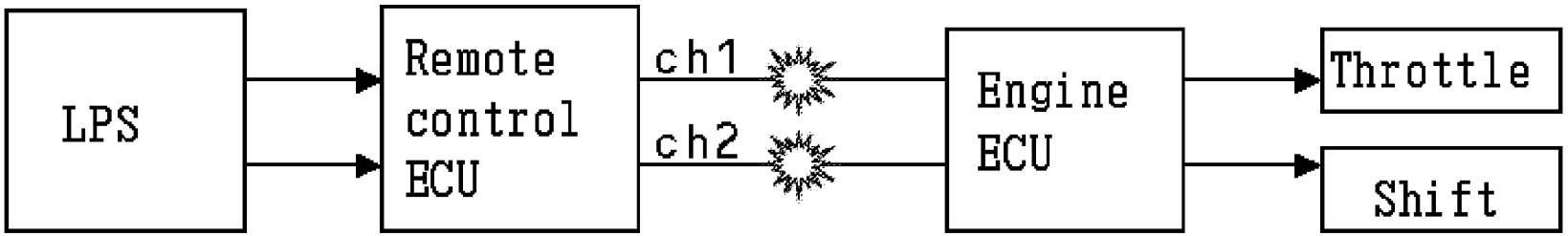
FIG. 6 is a view in which communication lines for performing communication is duplicated between a pair of nodes.
Figure 7:
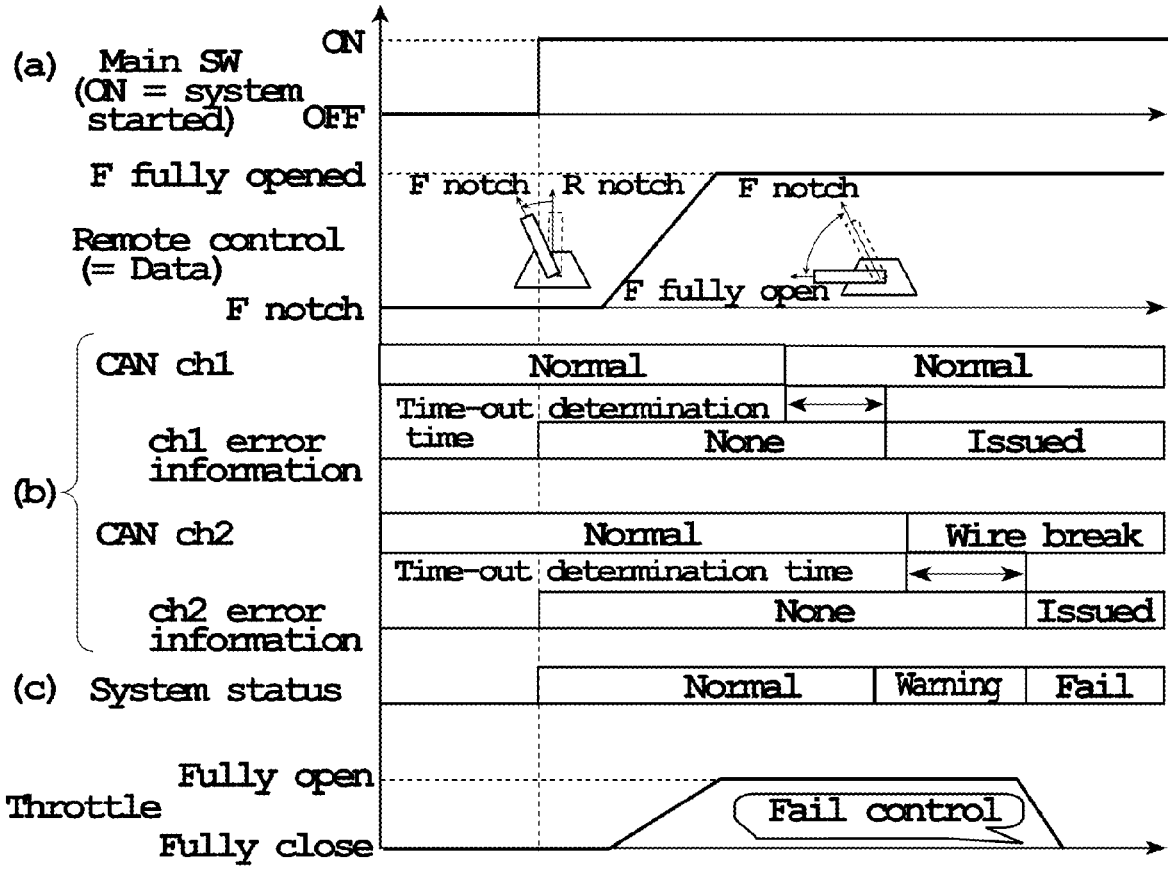
FIG. 7 is a time chart of the status in an assumed network with duplicated communication lines, in which FIG. 7(*a*) is a status of a system start, FIG. 7(*b*) is a status of the network, and FIG. 7(*c*) is a status of a system resulting from a wire break of a communication line.
Figure 8:
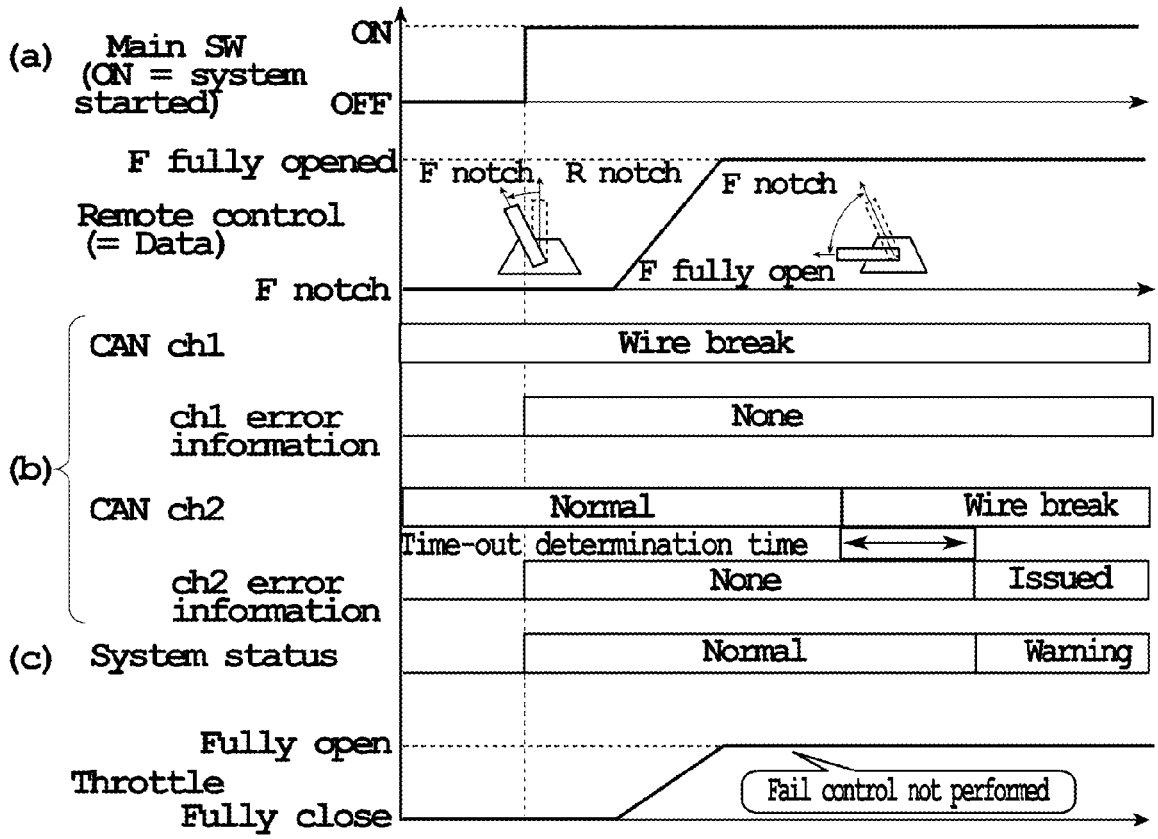
FIG. 8 is a time chart of the status in an assumed network with duplicated communication lines, in which FIG. 8(*a*) is a status of a system start, FIG. 8(*b*) is a status of the network, and FIG. 8(*c*) is a status of a system resulting from the wire break on a communication line.

As shown in FIG. 5, for example, if one HI line, for example, a1 is broken, the potential difference of the value "1" is not correctly detected. Therefore, the broken wire detection section 28 and the broken wire detection section 29 detect a bit error. When the engine side ECU 27 and the main remote control side ECU 17 detect the bit error, a bus off status in which communication is forcibly terminated (hereinafter referred to as the "bus off") is initiated. The engine side ECU 27 and the main remote control side ECU 17 in a status of the bus off at a certain time (t1) continuously output a bus off signal s3, which is a signal in a state of a pulse as shown in FIG. 5(*a*). Accordingly, the bus off signal s3 flows in the communications line a2 and so forth. In this case, if the LOW line is also broken at a certain time (t2) after the status of the bus off is initiated, communication is terminated completely. Consequently, a bit error is not detected in the engine side ECU 27 and in the main remote control side ECU 17 anymore. Therefore, the bus off signal s3 is not generated after the certain time (t2).

In addition, when the HI line is broken, data is not transmitted. Accordingly, as shown in FIG. 5(*c*), a time-out error counter starts counting. As shown in FIG. 5(*b*), after a predefined period of time (1 sec), a time-out error occurs (indicated by a solid line). Consequently, a time-out error flag s1 as a signal in a state of one pulse is generated. However, when the pulse of the bus off signal s3 is reset, the error flag is immediately cancelled. After this, a flat signal as low as the level before the occurrence of the error signal (s1) is maintained.

When only the HI line is broken (from t1 to t2), the error is generated. Accordingly, the broken wire detection sections 28 and 29 and the like determine that the warning mode should be initiated in accordance with the error status. On the other hand, if the LOW line is also broken, the bus off signal s3 is not generated. Therefore, the broken wire detection sections 28 and 29 and the like cannot determine that the warning mode, the fail safe mode, or the like should be initiated and thereby performs normal control.

In the preferred embodiments described above, control is performed to make the time-out error flag be in the signal status in which "0" is not set after "1" is set as long as the power supply is not turned off as indicated with s2 (dotted line) in FIG. 5(*b*). As a result, even when the LOW line is broken after the HI line is broken, the broken wire detection sections 28 and 29 and the like can continuously detect the error status.

According to the preferred embodiments described above, the main remote control side ECU 17 is provided with the storage buffers 34, 35, and 36 in which the communication status confirmation data for confirming whether or not communication between nodes can be performed by performing communication between the nodes is stored, and also the engine side ECU 27 is provided with a similar storage buffer (not shown). Further, the communication time of each communication status confirmation data is thereby monitored. In addition, the broken wire detection sections 28 and 29 are provided to determine that a communication line connecting node is broken if communication of the communication status confirmation data between the nodes is not detected within the predefined period of time as a result of the monitoring. Further, the broken wire detection section 28 of the engine side ECU 27 starts the determination when the boat control system is started, and the broken wire detection section 29 of the main remote control side ECU 17 starts the determination when communication status confirmation data is received from the other node. Consequently, a communication status with the main remote control side ECU 17 is surely detected in the engine side ECU 27. Further, a wire break of the communication line can be detected without difficulty in the main remote control side ECU 17 regardless of whether or not another remote control side ECU is provided on a side of the operator's seat or the number of other remote control side ECUs. As a result, it is possible to provide the main remote control side ECU 17 with a high versatility.

According to the preferred embodiments described above, the subremote control device 15 is provided besides the main remote control device 14, the subremote control side ECU 23 provided in the subremote control device 15 is connected to the main remote control side ECU 17 via the communication line, and the subremote control side ECU 23 is connected to the engine side ECU 27 via the main remote control side ECU 17. Further, a plurality of remote control side ECUs is provided, the main remote control side ECU 17 as one remote control side ECU among the remote control side ECUs directly communicates with the engine side ECU 27, and the subremote control side ECU 23 as another remote control side ECU indirectly communicates with the engine side ECU 27 via the main remote control side ECU 17. In the system having the construction described above, the wire break status of the communication lines "a" and "b" or the communication lines "c" and "d" in the communication system duplicated between nodes can be determined without difficulty.

According to the preferred embodiments described above, the data whose initial state is "1" indicating that communication between nodes is in an abnormal status is stored as communication status confirmation data in the main remote control data storage buffer 34 provided in the subremote control side ECU 23. Further, when receiving the communication status confirmation data from the main remote control side ECU 17 as another node, the broken wire detection section 30 provided in the subremote control side ECU 23 overwrites the communication status confirmation data stored in the confirmation data storage buffer with "0" indicating that the communication status is in a normal status and, at the same time as this, transmits overwritten communication status confirmation data "0" to the main remote control side ECU 17 as another node. Consequently, a wire break condition of the communication lines "c" and "d" formed as a duplicated system between the subremote control side ECU 23 and the main remote control side ECU 17 is determined easily and surely, only by a transmission status of data so that the wire break condition can be detected.

According to the preferred embodiments described above, the main remote control side ECU 17 and the subremote control side ECU 23 preferably include the main remote control data storage buffer 34, the subremote control data storage buffer 35, the engine data storage buffer 36, and the broken wire detection sections 29 and 30 constructed, respectively, in the same manner. Further, each of the broken wire detection sections 29 and 30 of the main remote control side ECU 17 and the subremote control side ECU 23 performs a determination, respectively, by using necessary data among the data stored in the storage buffers 34, 35, and 36. Consequently, it is possible to provide the main remote control side ECU 17 and the subremote control side ECU 23 to have the same construction with respect to hardware and software, and further a wire break of the duplicated communication lines between the main remote control side ECU 17 and the subremote control side ECU 23 is determined without difficulty. Accordingly, a wire break condition can be detected.

According to the preferred embodiments described above, the two communication lines "a" and "b" and the two communication lines "c" and "d" are provided to connect the nodes. In addition, the operation status switch sections 37, 38, and 39 initiate the warning mode for providing a warning status in which the boat propulsion system can operate if the broken wire detection device determines that one of the two communication lines is broken, and further, performs a control to initiate the fail mode as a status in which the boat propulsion system does not generate propulsive force if it is determined that the both of the two communication lines are broken. Consequently, when the wire break occurs in the communication lines "a" and "b" or the communication lines "c" and "d" arranged as a duplicated system, if navigation is still possible, the operator is given a warning, and continuous navigation is enabled. On the other hand, if navigation is impossible because of an occurrence of the wire break, it can be prevented that the boat is propelled in a condition in which navigation is impossible.

According to the preferred embodiments described above, even if the broken wire detection section 30 determines that both of the communication lines "c" and "d" connecting the main remote control side ECU 17 and the subremote control side ECU 23 are broken at a time of a start, the operation status switch sections 37, 38, and 39 prevent control for initiating the fail mode. Consequently, it is prevented that the system makes a transition to the fail mode to prohibit navigation in a status in which communication between the main remote control side ECU 17 and the engine side ECU 27 is possible and navigation is thereby possible. Further, it is prevented that navigation is unnecessarily obstructed on the basis of a result of an incorrect detection of a wire break condition.

According to the preferred embodiments described above, the operation status switch sections 37, 38, and 39 forcibly shift the throttle of the outboard motor 11 to the fully closed status at a time of the fail mode and forcibly shift the gear of the outboard motor 11 to the neutral status. Consequently, it is surely prevented that the outboard motor 11 generates a propulsive force when the system makes the transition to the fail mode.

In the preferred embodiments described above, the boat propulsion system is an outboard motor 11. However, the boat propulsion system may be an inboard motor, an inboard-outboard motor, or the like.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat control system for a boat propulsion system having an engine for providing a propulsive force to a boat, comprising:

an engine side ECU arranged to control an operation status of the boat propulsion system;

a main remote control side ECU, provided in a main remote control device of the boat, arranged to transmit a command signal on the basis of a boat operation command from an operator to the engine side ECU; and a communication line connecting a node of the engine side ECU and a node of the main remote control side ECU; wherein the engine side ECU and the main remote control side ECU each include:

a confirmation data storage buffer in which communication status confirmation data is stored to confirm whether or not communication between the nodes can be performed by communicating between the nodes; and a broken wire detection device arranged to monitor communication time of the communication status confirmation data and determine, as a result of the monitoring, that the communication line connecting the nodes, for which communication is not confirmed, is broken if communication of the communication status confirmation data is not confirmed between the nodes within a predefined period of time; wherein the broken wire detection device of the engine side ECU determines the result when the boat control system is started; and the broken wire detection device of the main remote control side ECU starts determination when the communication status confirmation data is received from the other node.

2. The boat control system according to claim 1, further comprising a subremote control device separate from the main remote control device, wherein a subremote control side ECU provided in the subremote control device is connected to the engine side ECU via the main remote control side ECU by connecting a node of the subremote control side ECU to the main remote control side ECU via a communication line.

3. The boat control system according to claim 2, wherein the subremote control side ECU includes a confirmation data storage buffer arranged to store data whose initial status indicates that communication between the nodes is in an abnormal status as the communication status confirmation data, and the subremote control side ECU includes a broken wire detection device arranged to overwrite the communication status confirmation data stored in the confirmation data storage buffer with data indicating that communication is in a normal status when the communication status confirmation data is received from one of the other nodes and transmits the overwritten communication status confirmation data to the other one of the nodes.

4. The boat control system according to claim 3, wherein the confirmation data storage buffer and the broken wire detection device in the main remote control side ECU and the subremote control side ECU have a similar construction, and each of the broken wire detection device of the main remote control side ECU and the subremote control side ECU performs determination respectively by using selected data among the data stored in the confirmation data storage buffer.

5. The boat control system according to claim 1, wherein the communication line connecting the nodes includes two communication lines, and the boat control system further comprises:

an operation status switch device arranged to set a warning mode for giving a warning in a status in which the boat propulsion system can operate when the broken wire detection device determines that only one of the two communication lines is broken, and to set a fail mode as a status in which propulsive force of the boat propulsion system is not generated when the broken wire detection device determines that both of the communication lines are broken.

6. The boat control system according to claim 5, wherein the operation status switch device is arranged to interrupt setting the fail mode when the broken wire detection device determines that the two communication lines connecting the main remote control side ECU and the subremote control side ECU are broken at a start of the boat control system.

7. The boat control system according to claim 5, wherein the operation status switch device is arranged to forcibly shift a throttle of the boat propulsion system to a fully closed status at a time of the fail mode and forcibly shift a gear of the boat propulsion system to a neutral status.

8. A boat comprising the boat control system according to claim 1.

* * * * *